United States Patent [19]

Bolstad

[11] 4,450,990

[45] May 29, 1984

[54] BACKPACK FRAME CONVERTIBLE TO A CHAIR AND CONVERSION ASSEMBLY THEREFOR

[76] Inventor: James J. Bolstad, 3526 N. Cramer St., Shorewood, Wis. 53211

[21] Appl. No.: 430,038

[22] Filed: Sep. 30, 1982

[51] Int. Cl.[3] ..... A45F 4/02

[52] U.S. Cl. ..... 224/155

[58] Field of Search ..... 224/155, 153, 154, 156

[56] References Cited

U.S. PATENT DOCUMENTS

| | | | |
|---|---|---|---|
| 3,620,428 | 11/1971 | Silverthorne | 224/156 |
| 3,828,992 | 8/1974 | Cerchione | 225/156 |
| 3,912,138 | 10/1975 | Pava | 224/156 X |
| 4,300,707 | 11/1981 | Kjaer | 224/155 |

*Primary Examiner*—Steven M. Pollard

*Attorney, Agent, or Firm*—Joseph J. Jockman, Jr.

[57] ABSTRACT

A backpack frame of the type including an upper U-shaped frame extension is convertible to a chair through the use of a lightweight conversion assembly including a pair of seat tubes demountably attached to the pack frame to divide the same into chair back and rear leg portions. The seat tubes carry a simple sling-type seat of canvas or the like and the opposite ends of the seat tubes are adapted to receive the free ends of the U-shaped frame extension which is removed from the backpack frame to provide the front legs of the chair. The entire conversion assembly is very light and occupies little space and can, therefore, be readily carried in the usual backpack attached to and used with the frame.

8 Claims, 6 Drawing Figures

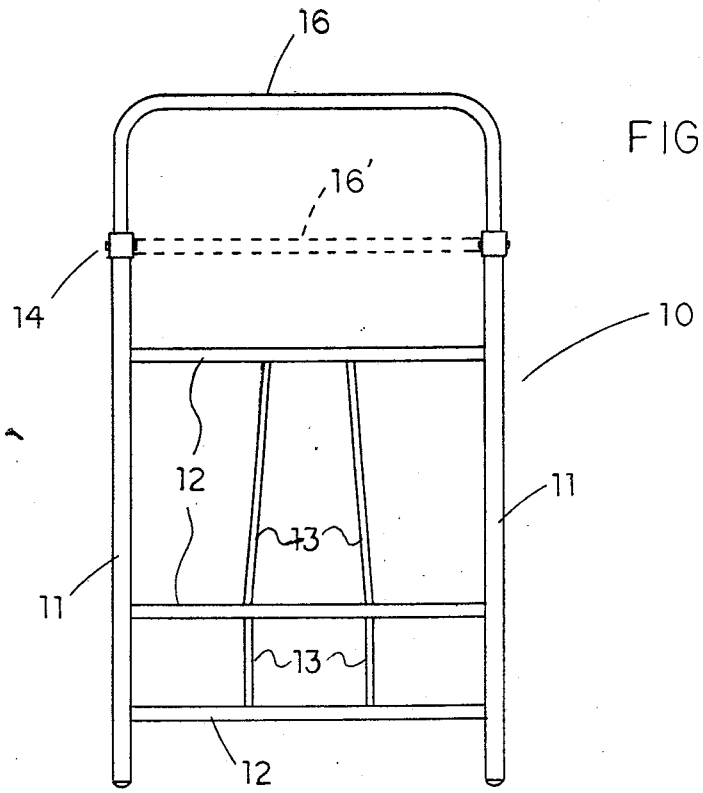
FIG 1
FIG 2
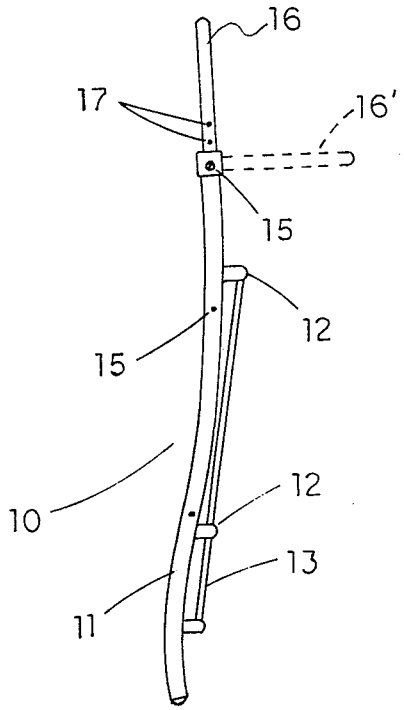
FIG 3
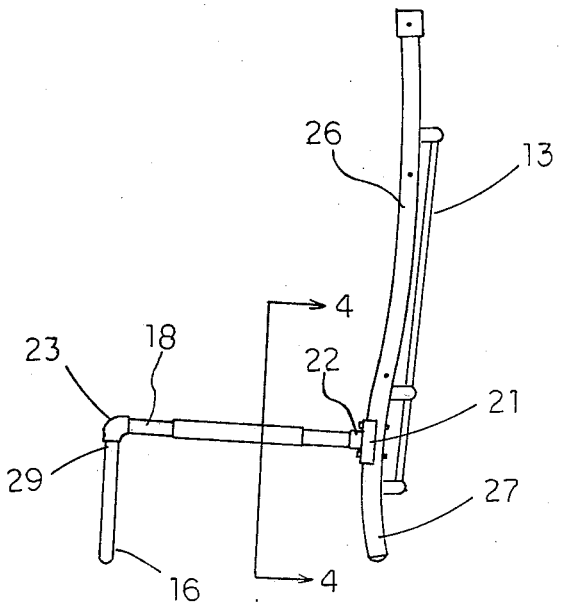

BACKPACK FRAME CONVERTIBLE TO A CHAIR AND CONVERSION ASSEMBLY THEREFOR

BACKGROUND OF THE INVENTION

The present invention relates to frames for backpacks that are convertible to form a chair or seat and, more particularly, to a lightweight assembly useful in converting several of the more popular types of pack frames available today.

Backpack frames constructed of lightweight tubular members of aluminum or other lightweight material are well known in the art. Such pack frames are typically of a generally rectangular construction, including vertically disposed side frame members and two or more horizontal connecting members. One or more cloth packs or bags, made of nylon, canvas or the like, are attached to the pack frame by means of a variety of demountable connectors. The pack frame, which is typically contoured to fit the user's back and shoulders, is mounted on the user's back by shoulder straps and, to aid in distributing the weight, often a hip belt.

To increase the utility and capacity of a backpack frame, a demountable U-shaped upper frame extension is often added to the basic rectangular frame member. Such frame extensions are generally attached directly to the upper ends of the tubular side frame members and may extend either vertically or horizontally therefrom. Examples of two presently popular contoured pack frames are shown in U.S. Pat. Nos. 3,733,017 and 4,087,031. The former utilizes upper U-shaped frame extensions of both the horizontally and vertically disposed type, and the latter discloses an upper frame extension arch of the generally vertically disposed type.

The prior art discloses a substantial number and variety of backpack frames which are convertible into chairs or seats. In one general type, the backpack frame is directly openable to form a single seat or chair with a backrest. Examples of such contructions are shown in U.S. Pat. Nos. 3,292,830, 3,315,856 and 4,300,707. Though providing the advantage of quick conversion, these directly convertible pack frames are all characterized by a distinct sacrifice in utility or comfort in either of their intended applications.

It is also known to convert a backpack frame to a chair by partial disassembly, reorientation and reassembly of some of the components. An example of such a construction is disclosed in U.S. Pat. No. 3,912,138. This patent discloses a sectional tubular pack frame which can be assembled to construct a wide variety of camping equipment, including a chair. The main side frame members have telescoping upper and lower side frame extensions which can be disassembled, reoriented and reassembled to provide a chair. However, in using only functional pack frame members to assemble the chair, functional utility of the members in one or the other of the applications is sacrificed and, as a result, either the pack frame, the chair, or both are less than satisfactory.

SUMMARY OF THE INVENTION

In the present invention, an assembly is provided which is useful in converting several of the more popular types of tubular metal backpack frames into a sturdy and comfortable camp chair. The conversion assembly is intended to be used with backpack frames of the type having a U-shaped upper frame extension, utilized to extend the size and capacity of the pack frame.

The main backpack frame provides the chair back and rear legs; and the upper frame extension, after demounting from the main frame and inverting, provides the front legs. The conversion assembly includes a pair of seat tubes which demountably interconnect the main backpack frame and the frame extension, and provide the lateral supports for the seat of the chair. The seat tubes each include first and second connector means on opposite ends, the first for attachment to the main pack frame and the second for receipt of a free end of the U-shaped frame extension. A flexible seat of canvas, nylon, or the like is attached to and extends between the seat tubes.

The seat tubes, like the pack frame, are preferably made of aluminum and, along with the connector means and seat, comprise a lightweight conversion assembly which adds little to the weight of a backpack. The connector means are both preferably permanently attached to the seat tubes. The first connectors may be clamped to the lower portion of the main vertical frame members to position the seat tubes to extend perpendicularly therefrom. The second connectors are preferably elbows, each of which is adapted to slidably receive one free end of the U-shaped frame extension.

The extra parts comprising the conversion assembly, though non-functional as backpack members, are particularly constructed to enable the adaptation of the entire pack frame to a sturdy and fully functional chair. As a result, neither the pack frame nor the chair requires the compromise of functional features of the other in providing its intended function.

BRIEF DESCRIPTION OF THE DRAWINGS

FIG. 1 is a front view of a backpack frame of a type for which the conversion assembly of the present invention is particularly suitable and further showing an alternate construction for the upper frame extension.

FIG. 2 is a side view of the backpack frame shown in FIG. 1.

FIG. 3 is a side view of the pack frame similar to FIG. 2 and additionally showing its conversion into a chair utilizing the assembly of the present invention.

DESCRIPTION OF THE PREFERRED EMBODIMENTS

Figure 4:
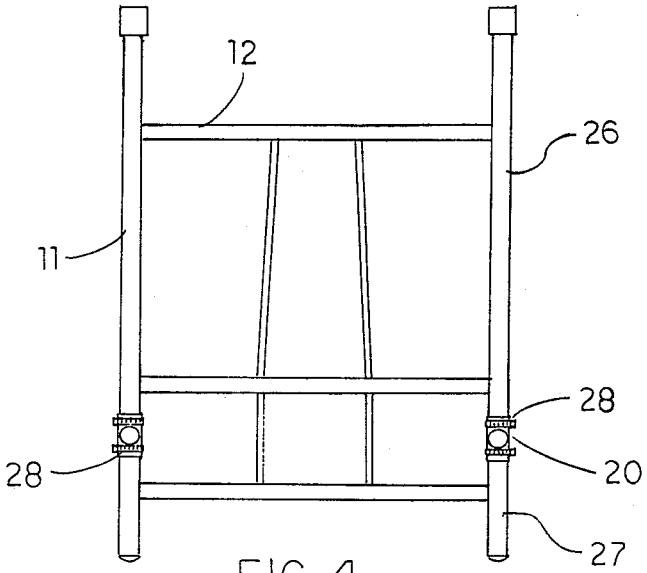
FIG. 4 is a front sectional view of the chair taken on line 4—4 of FIG. 3.

A backpack frame 10 typical of one kind in common use is shown in FIGS. 1 and 2. The frame includes a pair of vertical tubular side frame members 11 which are interconnected by at least two horizontal cross members 12 to provide a generally rectangular main frame. In the embodiment shown, there is an additional intermediate cross member 12 for a total of three. Cross members 12 are in turn interconnected by a pair of narrow rib members 13.

The side frame members 11 are contoured and the cross members 12 are slightly bowed to conform to the wearer's back. The front of the pack frame or the face lying against the wearer—s back is shown in FIG. 1 and, in the side view of FIG. 2, it can be seen that none of the components between the side frame members protrudes forward of that face to interfere with the comfort of the wearer. In use, bags, packs and other articles (not shown) are attached to frame 10 by means of clevis pins 14 extending through holes 15 in the tubular frame members and utilizing various types of fasteners well known in the art. The rib members 13 keep the packs attached to the frame from protruding through the front face of the frame. The shoulder straps (not shown) which may extend from the upper cross member 12 to the lower ends of the side frame members 11 are attached in a manner similar to the packs, as is the the hip strap (also not shown).

A U-shaped frame extension 16 is attached to the upper end of the main frame. The frame extension is made of smaller diameter tubing than the side frame members 11 and the free ends of the former are telescoped into the open upper ends of the latter. The legs of the extension 16 are provided with aligned pairs of holes 17 which, when aligned with the pair of holes 15 at the upper end of the side frame members, are adapted to receive clevis pins 14 for securing the two members together in any of several selected positions.

As an alternate or in addition to the vertically disposed frame extension 16, some pack frames employ a horizontally extending U-shaped frame extension 16' (shown in dashed lines in FIGS. 1 and 2). Such extensions 16' can not be telescoped into the side frame members and therefore other special types of connectors must be used. One such type is shown in U.S. Pat. No. 3,733,017. Regardless of the mounted position of the U-shaped frame extension 16 or 16', it functions primarily to provide additional carrying capacity.

To convert the backpack frame of FIGS. 1 and 2 into a chair and referring also to FIGS. 3 through 6, the main frame is used as the chair back and rear leg portions, the frame extension 16 provides the front legs, and the frame and frame extension are interconnected by a pair of seat tubes 18. The seat tubes provide the lateral supports for the chair seat 19 which is attached to and extends therebetween. Specially adapted connectors are used on the ends of the seat tubes 18 to provide secure and yet rapidly assemlable and demountable connections.

In the preferred embodiment shown, each seat tube 18 has a first connector 20 secured to one end and adapted to provide the connection to the frame 10. The first connector 20 comprises a modified T-joint in which the cylindrical transverse member is split to form a semicylindrical tube section 21 and the leg, extending perpendicularly therefrom, is a short hollow cylindrical stub 22. The seat tube 18 is adapted to be inserted into the hollow cylindrical stub 22 and, preferably, to be permanently secured therein by brazing, adhesives, or the like, depending on the materials used.

The opposite end of the seat tube 18 has a second connector 23 secured thereto which is adapted to provide the connection to the frame extension 16 being used for the front legs of the chair. The second connector comprises an elbow joint, one leg 24 of which is adapted to receive and permanently secure therein the end of the seat tube. The other leg 25 of the second connector 23 is adapted to slidably receive therein a free end of the U-shaped frame extension 16.

Figure 5:
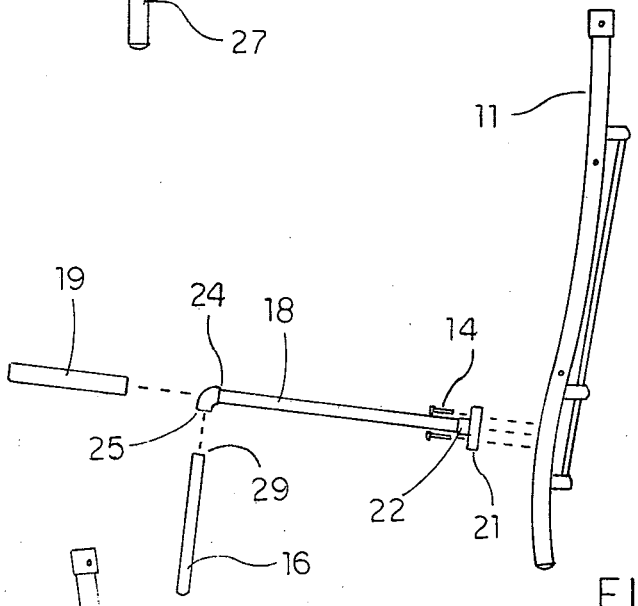
FIG. 5 is an exploded side view of the chair shown in FIG.3.
Figure 6:
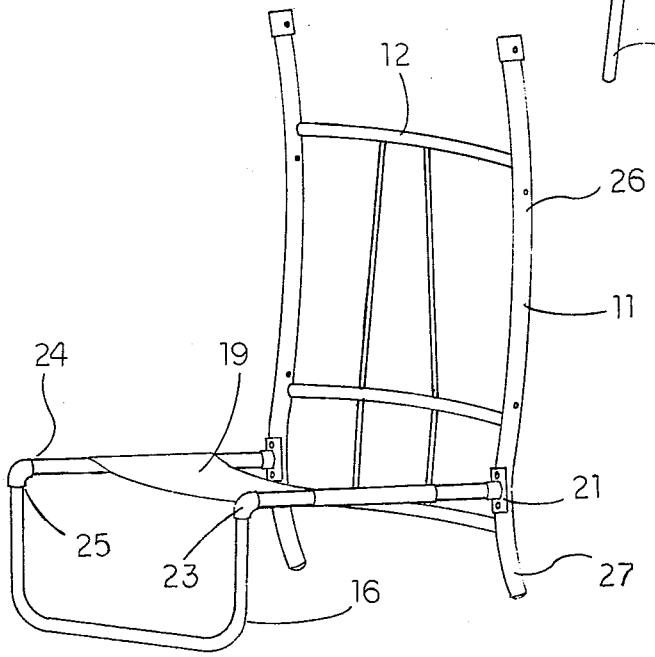
FIG. 6 is a perspective view of the backpack frame, including all the elements of the conversion assembly, fully assembled into a chair.

As is best shown in FIG. 5, the seat tube 18 and first and second connectors 20 and 23 comprise a single piece. The chair seat 19 comprises a rectangular piece of cloth or other suitable cloth-like material. The lateral edges of the seat 19 are folded back and sewn or otherwise secured to the interior to form an open tube-like hem large enough to be slipped over the second connector elbow 23 and onto the seat tube 18. The pair of seat tubes with integrally secured connectors and attached seat can be rolled into a compact bundle for easy storage in a pack mounted on the pack frame.

The seat tubes are attached via the first connectors 20 to the lower portions of the side frame members 11 such that these members are separated into upper chair back and lower rear leg portions 26 and 27, respectively, as may best be seen in FIGS. 3 and 4. The attached seat tubes 18 extend generally perpendicularly from the side frame members in spaced parallel relation. The first connectors 20 may be fastened to the side frame members 11 in any convenient manner which provides a rigid connection that can be relatively quickly and easily assembled and disassembled. The semicylindrical tube section 21 of each first connector 20 is adapted to overlie and receive in its convacity a portion of the tubular side frame member 11 at the selected point of attachment. One means for providing the actual connection is shown in FIG. 4 and comprises a pair of strap-type hose clamps 28 around each end of the semicylindrical tube section 21 and surrounding the side frame member 11. These hose clamps 28 may be left in place clamped to the side frame members when the seat tubes are demounted and the chair disassmebled. The hose clamps 28 will not interfere with use of the frame as a backpack. Another means for providing the connection of the seat tubes to the side frame members is shown in FIG. 5 and comprises a pair of clevis pins 14 extending through a pair of holes in the tube sections 21 and a pair of aligned holes in each side frame member 11. Such clevis pins may be attached in the same manner as those used to attach the frame extension 16 and the backpack to the main frame 10, as previously described as is well known in the art. In an alternate embodiment, the first connectors 20 may be permanently attached to the side frame members 11 and the seat tubes 18 slidably received with a snug fit in the stub members 22.

To complete the assembly of the chair, the frame extension 16 is demounted from the upper ends of the side frame members and the free ends 29 of the extension are inserted in the downwardly extending legs 25 of the second connector 23 to provide the chair front legs. The inner diameters of the legs 25 are dimensioned to receive the free ends 29 of the extension with a snug, hand-tight fit. The U-shaped frame extension in its converted position as the front legs of the chair provides good support and lateral stability to the assembly.

I claim:

1. In a backpack frame comprising a pair of generally vertically disposed, contoured tubular side frame members, two bowed cross members interconnecting the side frame members to form a generally rectangular frame having a front face adapted to conform to the back of the wearer, and a tubular U-shaped frame extension demountably attached by its free ends to the upper ends of the side frame members, an assembly for converting the backpack frame to a chair comprising:

(a) a pair of seat tubes each including first connector means attached to one end;

(b) each first connector means adapted to be attached to the lower portion of the front face of one side frame member to separate the same into the chair back and rear leg portions, and to hold the seat tubes in spaced parallel relation extending generally perpendicularly from the side frame members:

(c) a flexible seat member attached to and extending between the seat tubes; and, (d) second connector means for demountably attaching the free ends of the frame extension to the other ends of the seat tubes to extend downwardly therefrom and form the chair front legs.

2. The invention as set forth in claim 1 wherein the first connector means are permanently attached to the seat tubes.

3. The invention as set forth in claim 2 wherein the first connector means are demountably attached to the side frame members.

4. The invention as set forth in claim 3 wherein the second connector means comprises a pair of elbows each having one leg attached to the other end of a seat tube and the other leg adapted to slidably receive a free end of the frame extension.

5. The invention as set forth in claim 4 wherein the flexible seat member is demountably attached to the seat tubes.

6. The invention as set forth in claim 1 wherein each first connector means comprises:

(a) a semicylindrical tube section adapted to overlie the portion of the side frame member at its point of attachment thereto;

(b) a hollow cylindrical stub fixed to and extending generally perpendicularly from the outside of the tube section and adapted to receive the one end of the seat tube; and, (c) fastening means for attaching the tube section to the side frame member.

7. The invention as set forth in claim 6 wherein the fastening means comprises a pair of adjustable hose clamps.

8. The invention as set forth in claim 6 wherein the fastening means comprises a pair of demountable clevis pins.

* * * * *